US005330588A

United States Patent [19]

Gulley

[11] Patent Number: 5,330,588

[45] Date of Patent: Jul. 19, 1994

[54] ORGANIC-AQUEOUS COMPOSITION AND PROCESS FOR FORMING CORROSION-RESISTANT COATINGS ON METAL SURFACES

[75] Inventor: Harold J. Gulley, Cleveland, Ohio

[73] Assignee: E2KI & Associates Inc., Cleveland, Ohio

[21] Appl. No.: 12,733

[22] Filed: Feb. 2, 1993

[51] Int. Cl.[5] ..... C23C 22/48

[52] U.S. Cl. ..... 148/271; 148/270

[58] Field of Search ..... 148/270, 271

[56] References Cited

U.S. PATENT DOCUMENTS 2,035,380 3/1936 Wihelm ..... 148/266
3,457,124 7/1969 Bohman ..... 148/266
4,225,351 9/1980 Zuendt et al. ..... 106/14.12
4,711,735 12/1987 Gulley ..... 252/75
4,732,691 3/1988 Wirth et al. ..... 252/47.5

*Primary Examiner*—Richard D. Lovering
*Assistant Examiner*—Valerie Denise Fee
*Attorney, Agent, or Firm*—H. Jay Spiegel

[57] ABSTRACT

A two-part compositional mixture including a non-metallic concentrate with the appropriately blended requisite components in recommended amounts including $HNO_3$ provides a single bath and dip process system. The inventive concentrate is a multifunctional metallic interface conversion system which includes a Tri-basic acid and/or a selection from, Mono-, Di-, Tri and/or Poly-Carboxylic acid or their ester or derivatives. The inventive compositional concentrate inhibits metallic corrosion through deposition of a protective coating-/film on metallic surfaces which are exposed to atmospheric environments, water or water vapor.

18 Claims, No Drawings

ORGANIC-AQUEOUS COMPOSITION AND PROCESS FOR FORMING CORROSION-RESISTANT COATINGS ON METAL SURFACES

BACKGROUND OF THE INVENTION

A continuing problem exists in the field of protective coatings wherein zinc and cadmium are applied to a substrate such as a steel strip or article, to protect it against corrosion. The zinc or cadmium protective coating itself will corrode in time to give a white or whitish deposit commonly known as "Storage Stain" or "White Rust". It is common therefore to apply a thin protective coating to the zinc or cadmium surface which usually consists of a chromium compound or compounds and is known as a "Conversion" coating.

The conversion coating is usually formed by applying a suitable aqueous solution containing chromium to the zinc or cadmium surface, the aqueous solution reacting with the surface to form a thin gel-like film of complex chromates. The film is substantially non-porous to moisture, and also is noncrystalline, so that it provides a good paint bond without absorption of the paint onto the surface. Examples of processes for producing such a coating are disclosed in U. S. Pat. Nos. 2,035,380, issued Mar. 24, 1936 to Wilhelm, and 3,457,124, issued Jul. 22, 1969 to Bohman.

The process solutions disclosed in these patents include specified amounts selected from sodium dichromate/bichromate, chromic acid, sulfamic acid, ammonium sulfate, boric acid, sodium silicofluoride and nitric acid. One of the more widely used metallic conversion systems for aqueous treating of selected metals and/or their alloys (e.g., zinc, cadmium . . . applicable others) consists of incorporating into the system small amounts of a molecularly dehydrated alkali metal polyphosphate in combination with a soluble inorganic chromate such as sodium dichromate. This is known in the art as the "Polychrome" treatment, which while very effective in controlling applicable metallic corrosion resistance, is subject to many disadvantages.

One o f the major disadvantages of this treatment (Chromating) is the fact that the chromates are quite toxic and their use in systems which are eventually diverted into natural water sources has been substantially curtailed by Federal and Local regulations.

Other corrosion resistance filming/chromating compositions which contain one or both of the chromates or condensed phosphates are similarly subject to the disadvantages set forth above.

A further disadvantage of these and other prior art metallic conversion systems is their inability to function under a variety of adverse environmental conditions. Some metallic conversion compositions are further limited in that they can be utilized with only a few applicable types of metals.

Different compounds/components act as and/or provide corrosion resistance for different metals. Often, aqueous systems are made up of more than one metal. Therefore, to assure maximum metallic conversion resistance, it is beneficial to employ a conversion corrosion resistance composition which will protect a variety of metals and preferably be effective under diverse operating conditions. Thus sodium mercaptobenzothiazole and/or benzothiazole are often utilized to impart surface corrosion resistances to copper, sodium dichromate for mild steel, and sodium borate together with sodium nitrate to impart surface corrosion resistance to cast Iron. However, it is seen that merely combining known individual metal corrosion retardants/inhibitors together, will not give adequate protection under a variety of conditions without the disadvantages set forth previously.

Applicant is also aware of U.S. Pat. No. 4,225,351 to Zuendt et al. This patent discloses a non-toxic solution designed to impart improved brightness and corrosion resistance to metal surfaces such as, for example, zinc-plated surfaces. While these general purposes are shared by the present invention, Applicant herein has discovered a different combination of constituent ingredients in much smaller proportions which is at least as effective as the Zuendt et al. composition.

Applicant also wishes to make reference to Applicant's prior U.S. Pat. No. 4,711,735 which discloses a coolant additive with corrosion inhibitive and scale preventative properties. While the additive disclosed in the prior patent is specifically intended for use in combination with a coolant with particular application to coolants used in conjunction with diesel engines, the composition disclosed in this patent application is more general in scope and is applicable to coat and protect metallic surfaces whether or not a coolant is being employed and whether or not the environment consists of the cooling system of an engine.

SUMMARY OF THE INVENTION

Through use of the compositions disclosed herein, a multifunctional aqueous process system results which forms superior protective metal/alloy coatings against atmospheric corrosion under diverse operating environments, but without the disadvantage of ,toxicity and while presenting no safety hazard in handling.

Hence, it is an object of the present invention to provide improved compositions for the treatment and prevention of metallic surface corrosion.

More specifically, the compositions of the present invention provide replacements for the present day "State-Of-The-Art " chromates as well as improved corrosion resistance and/or passivation of a wide variety of metallic surfaces. These compositions are non-toxic (i.e., they contain no supplied Heavy Metals) to lower mammalian and aquatic life, and externally to humans. Furthermore, the disclosed compositions contain no components which revert to undesirable products. That is, the dominant, applicable Tri-Carboxylic Acid is completely biodegradable under the "STURM TEST" conditions and can be utilized under a multiplicity of operating conditions ( temperatures, PH( s ) and/or environmental ).

Another object is to provide an improved compositional concentrate which is non-toxic and which does not give rise to undesirable by-products.

Still another object of the present invention is to provide an aqueous system treatment composition which will function under a wide variety of adverse operating conditions, and which can be employed with a multiplicity of metals.

A further object of the present invention is to provide an improved metallic retardant composition which can be utilized in several forms, such as CHEMISORPTION, and including powder, liquid, particulate, dispersion, activated adsorption and catalyses/catalysts, e.g., heterogeneous catalysis.

A further object is to provide an aqueous system surface corrosion retardant which can be employed in a plurality of applications.

Another object is to provide an aqueous system metallic corrosion retardant composition which can be applied on a one step basis by continuous feeding, or by intermittent addition.

An additional object of this invention is to provide a method of inhibiting metallic surface corrosion in atmospheric systems.

Yet another object is to provide a method of preventing corrosion on metallic surfaces.

A still further object is to provide a method of inhibiting corrosion on metallic surfaces which are found in a wide variety of industrial and commercial applications.

An additional object is to provide an aqueous system treatment composition which can be employed without the formation of undesirable side products and which can be handled safely and which will not be toxic to man and his environment.

These and other objects, aspects and features of the present invention will be better understood from the following detailed description of the preferred embodiments thereof.

SPECIFIC DESCRIPTION OF THE PREFERRED EMBODIMENTS

The novel technology of the present invention comprises several steps and the relation and order of one or more of such steps with respect to each of the others, and the products possessing the features, properties and the relation of elements which are exemplified in the following detailed disclosure, and the scope of the application of which will be indicated in the claims.

For a fuller understanding of the nature and objects of the invention, reference should be had to the following detailed description.

Chemisorption is defined as "the formation of bonds between the surface molecules of a metal (or other material of high energy) and another substance (gas or liquid) in contact with it." The bonds so formed are comparable in strength to ordinary chemical bonds, and much stronger than the Van der Waals type characteristic of physical adsorption. Chemisorbed molecules are almost always altered, e.g., hydrogen molecules are chemisorbed on metal surfaces as hydrogen atoms; chemisorption of hydrocarbons may result in the formation of chemisorbed hydrogen atoms and hydrocarbon fragments. Even when dissociation does not occur, the properties of the molecules are changed by the surface in important ways.

A practical example of chemisorption is the boundary lubrication of moving metal parts in machinery. A film of oil forms a chemisorbed layer at the interface surface and averts the high frictional forces that would otherwise exist. Solids with high surface energies are necessary for chemisorption to occur. Examples of such solids include nickel, silver, platinum and iron.

An interface consists of "the area of contact between two immiscible phases of a dispersion, which may involve either the same or different states of matter." Five types are possible: (1) solid/solid ( i.e., carbon black-/rubber); (2) liquid/liquid ( i.e., water/oil ); (3) solid/-gas (i.e., smoke/air); (4) solid/liquid (i.e., clay/water); (5) liquid/gas ( i.e., water/air). At a fresh surface of either a liquid or solid, the molecular attraction exerts a net inward pull. Hence, the characteristic property of a liquid is surface tension and that of a solid surface is adsorption. Both have the same cause, namely, the inward cohesive forces acting on the molecules at the surface. These phenomena provide to some degree the fundamental mechanism for many industrially important processes (catalysis, emulsification, mixing, alloying) and products (detergents, adhesives, lubricants, paints). Such properties as wettability of solid powders, spreading coefficients of liquids, and protective action of colloidal substances are intimately associated with interfacial behavior.

One aspect of the present invention is the provision of metallic surface corrosion retardant composition comprising: (I) a water soluble, heavy-metal-deactivator, tribasic carboxylic acid, (II) a water soluble and/or dispersible (short chain/lower molecular) styrene and maleic anhydride (SEA) copolymer, (III) a water soluble silicate, an inorganic catalyst, gel-suspension or salt (alkali metal), (IV) an inorganic acid or derivatives thereof, the nature to be defined below.

A metal silicate, where employed, can be any alkali metal silicate, preferably sodium silicate or other sodium metasilicate.

The tribasic (and/or derivatives -, Mono, Di, Tri and Poly-) ion(s) of section (I) above may be derived from any water soluble applicable and feasible esters and/or salts of non-heavy-metals and mixtures thereof.

The concentration of the tribasic ion or the composition formulation should be within the range of less than $3.33\times10^{-3}$ to about 10-g/L of total composition. Little, if any, operational advantage is derived from employing more than about 10-g of tribasic organic ion per Liter of composition.

The short-chain copolymers of styrene and maleic anhydride (SMA) employable herein are selectable from among any of the wide variety of water soluble copolymer agents presently or contemplated to be available in the marketplace, so long as they are compatible with the other components of the composition and with the metal surface being treated, as such compatibility should be understood by those skilled in the art.

The alkali metal silicate sufficient to provide water soluble silicate is preferably provided in an amount of 0.223 to 8% by volume in the mixture.

A preferred combination of constituent ingredients combinable together in accordance with the teachings of the present invention is as follows:

| Component | % by weight |
|---|---|
| PART 'A' | |
| "Evanacid 3CS" (Carboxymethylmercaptosuccinic acid) | 0.333 |
| SMA-2625A (Styrene Maleic Anhydride) | 0.100 |
| $NaHSO_3$ (Sodium Bisulfite) | 0.00167 |
| $NaNO_2$ (Sodium Nitrite) | 0.067 |
| HCl | 0.0415 |
| $HNO_3$ | 0.0415 |
| VINMET 1140/40%: Production Stock SO1n-2.5% (Sodium Dimethyldithiocarbamate) | 0.083 |
| CALIFAX DB-45 | 0.250 |
| $NaNO_3$ (Sodium Nitrate) | 0.267 |
| DI (with minerals removed) or Softened Water | Balance |
| PART 'B' | |
| Sodium Silicate | 0.25 |
| Softened Water | Balance |

The inventive composition maintains effectiveness provided the constituent ingredients are included with the following ranges:

| | Approximate % by weight in the mixture |
|---|---|
| Component Part 'A' | |
| Complexing Agent/Deactivator/ 3CS (CMS) | $3.33 \times 10^{-5}$ to 16.65 |
| Dispersing Agent/Dispersant- 2625A (SMA) | $1.00 \times 10^{-5}$ to 5.0 |
| Reducing Agent-Mordant $NaHSO_3$ | $1.67 \times 10^{-5}$ to 8.35 |
| Diazotizing/Oxidizing Agent and Steel Inhibitor/$NaNO_2$ | $0.67 \times 10^{-5}$ to 3.35 |
| Diazotizing Agent/Acidizing-isomerization HCL | $0.415 \times 10^{-5}$ to 2.083 |
| Oxidizing Agent $HNO_3$ | $0.415 \times 10^{-5}$ to 2.083 |
| Non-Ferrous Metals Corrosion Inhibitor VINMET 1140/2.5% SDDC | $0.83 \times 10^{-5}$ to 4.150 |
| SURFACTANT - Califax DB 45 (Disulfonated Alkyl Diphenyl Oxide) | $2.50 \times 10^{-5}$ to 12.500 |
| Oxidizing Agent and Fe - Al Inhibitor/$NaNO_3$ | $2.67 \times 10^{-5}$ to 13.35 |
| DI or Softened Water | Balance |
| Component Part 'B' | |
| Catalyst - Binding Agent/Dispersing Agent - Polymeric Electrolyte(s) (Alkali Metals Silicate); Preferably Sodium Silicate | $2.50 \times 10^{-5}$ to 12.50 |
| Softened Water | Balance |

All of the ingredients found in the novel compositions are commonly used chemicals and may be obtained from many commercial sources. The liquid silicate mixtures are also commercially obtainable. They are conventional "syrupy" liquid, soluble in water.

The constituent ingredients described above for Parts A and B have been chosen due to their synergism as combined, as discovered during Applicant's research in developing the inventive solution. "Evanacid 3CS" is a metal deactivator and stabilizer. It is also an anti-oxidant effective in preventing the development of peroxides in oil or shortening. It also prevents discoloration of soaps from trace metals. SMA provides part of the insoluble matrices/polymers and facilitates phase separation of them from the fluid medium surrounding them, a prerequisite for a feasible heterogeneous catalyst such as, for example, polyorganosilicate graft polymer. A pertinent example is the bonding of styrene to a polysilicate containing vinyl radical resulting in the growth of polystyrene chains from the surface of the silicate. The same change may be obtained through the use of organoclay.

$NaHSO_3$ is a reducing agent preventing the dissolution of iron, steel, etc. $NaNO_2$ is an oxidizing agent known as a ferrous metal inhibitor. When this substance is combined with HCl, it diazotizes and imparts blue color to the coating/deposit.

The acids HCl and $HNO_3$ convert the "Evanacid" and other organic materials to free acids, while maintaining free acid in the bath and introducing metal dissolution. The acids also act as a pH adjustor.

$NaNO_3$ is an oxidizing agent and metal inhibitor with penetrating properties. This substance is particularly useful in facilitating protection by the inventive solution of cast aluminum, cast iron and articles with rough surfaces. $NaNO_3$ also acts as a color fixative and preservative.

Sodium silicate is a catalyst for otherwise insoluble matrices/polymers.

Since the novel, metal protective mixture is blended, and the ingredients selected to achieve the particular results, as previously described, have a long shelf-life even after both parts A and B have been blended with $HNO_3$, mixed and the coating solution is ready for use.

As a result of investigations, Applicant has discovered concentration modifications of the applicable invention which will form both "clear coatings" and "yellow irridescent coatings" on metals/alloys and/or articles made of or coated with zinc or cadmium.

With an applicable adjusted Bath's Chemistry, the multicolor coatings can be produced on receptive metallic surfaces and are, within the scope of the invention, reproducible results.

The present invention may be carried out by employing a blend of the invention concentrates A and B and the requisite percent volume of Nitric Acid, e.g., blend (well shaken and/or thoroughly mixed) Part 'A' % by volume as described above with the requisite amount of ambient tap water, to which is added the required % by volume of $HNO_3$ and the requisite % by volume of Part 'B'. Free mineral acids and/or compatible mono-basic organic acids, e.g., Formic acid, may be added, if desired.

The coating is formed in all blended/mixed modifications of the invention by simply immersing the article in the solution and moderately agitating for periods ranging from less than 15 seconds to 2 minutes, while periods of from 20 to 30 seconds are usually of sufficient duration to produce satisfactory results. Agitation should be sufficient to maintain bath equilibrium/stable pH of the working bath. When the bath is static, rising pHs are produced as well as other undesirable chemical effects. The immersion time depends somewhat upon the concentrate's percent by volume of the solution being used, but chiefly upon the composition of the metal being treated. The longer immersion periods may be used with rolled cadmium or zinc, galvanized iron, or a rolled zinc-base alloy containing, for example, about 1% copper and 0.01% magnesium and so on.

The present invention provides yellow or clear carboxylated/organic conversion coating on metals/alloys and/or articles made from or coated with cadmium or zinc by employment of aqueous bath of the following types.

CLEAR COATINGS

An aqueous solution of 0.04332 % by volume Part 'A';
$HNO_3$ % by volume 0. 223;
Part 'B' % by volume 2.67; and
Balance Tap Water.

YELLOW IRRIDESCENT COATINGS

An aqueous solution of 0.025 % by volume Part 'A';
0.75 % by volume $HNO_3$;
3.33 % by volume Part 'B'; and
Balance Tap Water.

The above working solutions are made up by using the inventive concentrate percent by volume and diluting with (ambient tap) water. The above solutions are used at ambient temperature with a dip time of approximately 30 seconds.

| CLEAR COATINGS | |
|---|---|
| Maximum pH range | 2 to 5.45 |
| Preferred pH range | 2.46 to 3.06 |

-continued

| | |
|---|---|
| Optimum pH | 2.74 |
| YELLOW IRRIDESCENT COATINGS | |
| Maximum pH range | 2 to 14 |
| Preferred pH range | 2.5 to 4.2 |
| Optimum pH | 2.78 |

The ranges of Part A, $HNO_3$ and Part B, as a percentage in the entire solution, within which the present invention will be effective are as follows:

| | |
|---|---|
| Part A | .02% to .05% |
| $HNO_3$ | 0.2% to 0.8% |
| Part B | 2% to 4% |

In utilizing the inventive solution, Part A and Part B are first separately mixed utilizing the constituent ingredients in the proportions within the ranges listed above. A container is filled with water at a pre-measured volume thereof. To this pre-measured volume, Part A in the proportion by volume of 0.02% to 0.05% of the volume of the water within the container is added thereto and thoroughly mixed. Thereafter, $HNO_3$ in the proportion by volume of 0.2% to 0.8% is added and thoroughly mixed. Thereafter, pre-mixed Part B in the proportion of 2% to 4% by volume of the entire volume of water is added thereto and thoroughly mixed. With these steps having been completed, the solution within the container may be utilized in accordance with the teachings of the present invention to form protective coatings as described hereinabove.

While the present invention will perform as intended so long as the constituent ingredients are mixed in the proportions described above, one may follow the proportions described above for "CLEAR COATINGS+ and "YELLOW IRRIDESCENT COATINGS" more precisely to provide those results.

The present invention tremendously increases the ability to provide a feasible protective coating on metallic parts and surfaces. When its molecules are chemisorbed, they are almost always altered. That is, hydrogen molecules are chemisorbed on metallic surfaces as atoms; hydrocarbons may result in the formation of chemisorbed hydrogen atoms and hydrocarbon fragments all of which improve the chances for successful and effective bonding of deposits and coatings.

Furthermore, the inventive solution is selective, in that the inventive solution is catalyzed by solid surfaces in an interface reaction. As such, a key aspect of the inventive solution is that it represents a cycle which occurs many times as the reaction proceeds. Each repetition of the cycle is called a "turnover". An effective catalyst will cause millions of "turnovers".

Due to the selectivity described above, there is no net consumption or production of the catalytic site. The reaction proceeds by repetition of the catalytic cycle or chain with the catalytic species remaining essentially unchanged at the conclusion. Due to this phenomenon, the extremely low concentration of the inventive solution within the diluting tap water gives rise to quite effective results. Furthermore, due to the interface reaction described above, levels of dissolved metals in the solution are significantly reduced.

Through experimentation, as per ASTM B 117 (salt spray), unlike chromates, specimens processed by dipping them into the inventive solution did not aggressively errode. The specimens retained their zinc deposits and corroded via diffusion, i.e., penetrating through their deposits. This is improved performance over the prior art.

During experimentation, it was discovered that the inventive solution produces the best results when maintained at chemical equilibrium and while being moderately agitated.

During experimentation, Applicant discovered that the pH of the mixed solution exhibits a narrow range change when in use, for example, having an initial pH of 2.54 before specimens to be coated are introduced and with the pH lowering to 2.48 to 2.50 at the conclusion of the process. However, when the coated specimens are removed, soon thereafter, the solution returns to the starting pH. However, if agitation of the solution is stopped, after several hours, the pH will increase to near a neutral pH of 7.0.

Any specimen introduced into the solution before a stable dynamic pH has been obtained through agitation will show varying shades on its surfaces. Applicant has found that when the pH has elevated, agitation will stabilize pH within a desired range.

As such, an invention has been disclosed in terms of a composition and process for forming coatings therewith which fulfills each and every one of the objects set forth hereinabove and provides a new and useful organic-aqueous composition and process for forming corrosion-resistant coatings on metal surfaces of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A non-toxic composition for imparting a corrosion resistant film on metallic surfaces, comprising:

a) a first solution having the following ingredients mixed together in the percentages by weight of the total first solution as indicated:
   i) $3.33\times10^{-5}$ to 16.6% Carboxymethylmercaptosuccinic acid;
   ii) $1.0\times10^{-5}$ to 5% styrene maleic anhydride;
   iii) $1.67\times10^{-5}$ to 8.35% $NaHSO_3$;
   iv) $0.67\times10^{-5}$ to 3.35% $NaNO_2$;
   v) $0.415\times10^{-5}$ to 2.083% HCl;
   vi) $0.83\times10^{-5}$ to 4.15% Sodium Dimethyldithiocarbamate;
   vii) $2.5\times10^{-5}$ to 12.5% Disulfonated Alkyl Diphenyl Oxide;
   viii) $2.67\times10^{-5}$ to 13.35% $NaNO_3$;
   ix) Balance $H_2O$;

b) a second solution having $2.5\times10^{-5}$ to 12.5% by weight Sodium Silicate and the balance $H_2$);

c) said composition being prepared by adding 0.02% to 0.05% by volume of said first solution to a volume of water and mixing, thereafter adding 0.2% to 0.8% by volume of $HNO_3$ to said volume of water and mixing, and thereafter adding 2% and 4% by volume of said second solution in said volume of water and mixing, whereby said composition is formed.

2. The composition of claim 1, wherein said balance $H_2O$ in said first solution comprises at least 98% by weight of said first solution.

3. The composition of claim 1, wherein said balance $H_2O$ in said second solution comprises at least 99% by weight of said second solution.

4. The composition of claim 2, wherein said balance $H_2O$ in said second solution comprises at least 99% by weight of said second solution.

5. The composition of claim 1, wherein said first solution contains 0.33% by weight carboxymethylmercaptosuccinic acid.

6. The composition of claim 1, wherein said first solution contains 0.1% by weight styrene maleic anhydride.

7. The composition of claim 1, wherein said first solution contains 0.00167% by weight $NaHSO_3$ and 0.067% by weight $NaNO_2$.

8. The composition of claim 1, wherein said first solution contains 0.0415% by weight HCl and 0.0415% by weight $HNO_3$.

9. The composition of claim 1, wherein said first solution contains 0. 083% by weight Sodium Dimethyldithiocarbamate.

10. The composition of claim 1, wherein said first solution contains 0.25% by weight Disulfonated Alkyl Diphenyl Oxide.

11. The composition of claim 1, wherein said first solution contains 0.267% by weight $NaNO_3$.

12. A non-toxic composition for imparting a corrosion resistant film on metallic surfaces, comprising:

a) a first solution having the following ingredients mixed together in the percentages by weight of the total first solution as indicated:

i) 0.33% Carboxymethylmercaptosuccinic acid;

ii) 0.1% styrene maleic anhydride;

iii) 0. 00167% $NaHSO_3$;

iv) 0.067 % $NaNO_2$;

v) 0.0415% HCl;

vi) 0. 0415% $HNO_3$;

vii) 0.083% Sodium Dimethyldithiocarbamate;

viii) 0.25% Disulfonated Alkyl Diphenyl Oxide;

ix) 0. 267% $NaNO_3$;

x) 98. 81833% $H_2O$;

b) a second solution including 0.25% by weight Sodium Silicate and 99.75% water;

c) said composition being prepared by adding 0.02% to 0.05% by volume of said first solution to a volume of water and mixing, thereafter adding 0.2% to 0.8% by volume of $HNO_3$ to said volume of water and mixing, and thereafter adding 2% to 4% by volume of said second solution in said volume of water and mixing, whereby said composition is formed.

13. The composition of claim 12, wherein 0.04332% by volume of said first solution is added.

14. The composition of claim 13, wherein 0.223% by volume of $HNO_3$ is added.

15. The composition of claim 14, wherein 2.67% by volume of said second solution is added.

16. The composition of claim 12, wherein 0.025% by volume of said first solution is added.

17. The composition of claim 16, wherein 0.75% by volume of $HNO_3$ is added.

18. The composition of claim 17, wherein 3.33% by volume of said second solution is added.

* * * * *